United States Patent [19]

Windom

[11] Patent Number: 4,660,445

[45] Date of Patent: Apr. 28, 1987

[54] BOTTLE OPENER

[76] Inventor: Jeff J. Windom, Main Dr., Rte. 2, Box 187D, Tallapoosa, Ga. 30176

[21] Appl. No.: 850,490

[22] Filed: Apr. 11, 1986

[51] Int. Cl.[4] ..... B67B 7/18

[52] U.S. Cl. ..... 81/3.43

[58] Field of Search ..... 81/3.4, 3.43, 64; 24/279, 280, 274 P, 274 R

[56] References Cited

U.S. PATENT DOCUMENTS

| | | | |
|---|---|---|---|
| D. 193,899 | 10/1962 | Harrison | 81/3.4 |
| D. 230,815 | 3/1974 | Ono | D8/40 |
| D. 231,313 | 4/1974 | Heelan | D8/40 |
| D. 277,160 | 1/1985 | Antone | 81/3.4 |
| 1,919,708 | 7/1933 | Adams | 81/3.4 |
| 2,014,108 | 9/1935 | Hawke | 81/3.43 |
| 2,498,934 | 2/1950 | Webb | 81/3.43 |
| 2,519,447 | 8/1950 | Ensminger | 81/64 |
| 2,985,044 | 5/1961 | Gill | 81/3.4 |
| 3,038,178 | 6/1962 | Schumacher | 81/3.4 |
| 3,121,355 | 2/1964 | Morel et al. | 81/3.4 |
| 4,082,016 | 4/1978 | Vonusa | 81/3.43 |
| 4,150,591 | 4/1979 | Ackeret | 81/3.43 |
| 4,350,063 | 9/1982 | Kochler | 81/64 |

*Primary Examiner*—Roscoe V. Parker

*Attorney, Agent, or Firm*—Michael C. Smith

[57] ABSTRACT

A bottle opener for reducing the amount of hand strength needed to open a twist cap bottle comprising a generally domed shaped housing, an adjustable clamp secured within said housing for encircling various sized bottle caps and a remote adjustment handle extending through said housing for adjusting said clamp, further provided that the size of the housing and the remote handle provides substantial leverage for twisting a bottle cap clamped therein.

9 Claims, 2 Drawing Figures

BOTTLE OPENER

TECHNICAL FIELD

The present invention relates generally to a bottle opener and specifically to a bottle opener adapted for reducing the amount of hand strength needed to open a twist cap bottle or the like.

BACKGROUND ART

Bottle openers are well known in the art. Examples of openers for crimped bottle caps are shown in U.S. Pat. No. 3,038,178 and U.S. Pat. No. Des. 231,313. Bottle openers for screw type caps are shown in U.S. Pat. No. 2,519,447 and in U.S. Pat. Nos. Des. 193,899 and Des. 277,160. A remover for twist type jar and bottle caps is shown in U.S. Pat. No. 2,985,044. Other opening devices are shown in U.S. Pat. Nos. 1,919,708; 3,121,355; and 4,082,016 and in U.S. Pat. No. Des. 230,815. While all of these openers are relatively effective, there remains a need to provide a bottle opener for twist cap bottles which reduces the amount of hand strength needed to twist open the bottle. It is for this reason that the present bottle opener was invented.

DISCLOSURE OF INVENTION

Since many individuals, such as the elderly, have significant difficulty in removing small twist off bottle caps, the present invention reduces the amount of hand strength needed to open a twist cap bottle. This invention is a twist cap bottle opener having an enlarged, generally domed shaped housing, an adjustable clamp secured within the housing for encircling various sized bottle caps and a remote adjustment handle extending through the housing for adjusting the clamp. The enlarged size of the housing and the remote handle provide substantial leverage for twisting a bottle cap.

Thus, a major object of the present invention is to provide apparatus to reduce the amount of hand strength needed to open a twist cap bottle.

BRIEF DESCRIPTION OF THE DRAWINGS

While the specification concludes with claims particularly pointing out and distinctly claiming the subject matter which is regarded as the invention, it is believed that the invention, objects, features and advantages thereof will be better understood from the following description taken in connection with the accompanied drawings in which like parts are given like identification numerals and wherein:

BEST MODE FOR CARRYING OUT THE INVENTION

Figure 1:
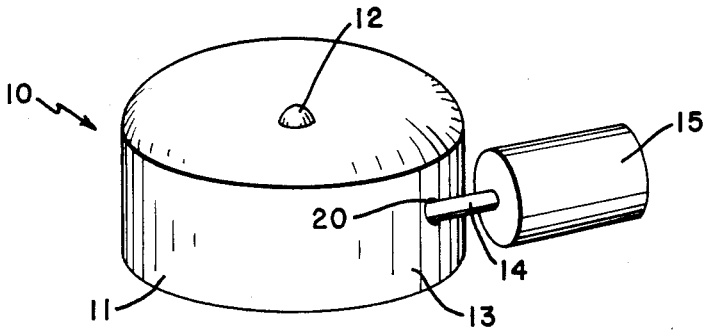
FIG. 1 is a top perspective view of the invention showing the top and outer surfaces thereof.

Referring now to FIG. 1, which shows the top and outer surfaces of the bottle opener indicated generally at 10, it can be seen that housing 11 is generally dome shaped. Housing 11 is somewhat larger than a variety of bottle caps it is designed to remove, and is sufficiently large to provide for convenient grasping thereof. The preferred outer diameter of housing 11 is from about 2.50 inches to about 3.0 inches, while the most preferred outer diameter is 2.75 inches. While the outer diameter is more critical than the height of the dome 11, it is preferred that the dome have a height of about 1.50 inches. Near the summit of the dome 11 is an eccentric securement means 12 which will be discussed in more detail below. Protruding from a vertical tubular wall 13 of dome 11 is a shaft 14 to which is secured handle 15.

Figure 2:
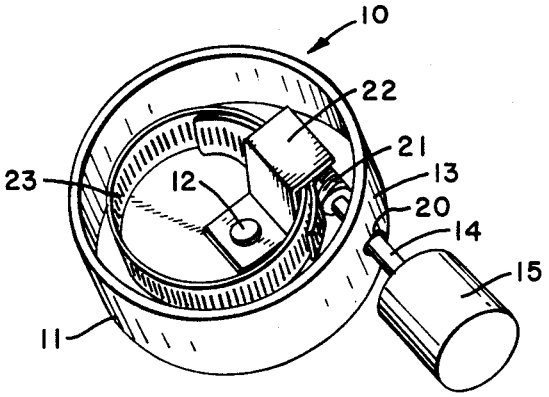
FIG. 2 is a bottom perspective view of the invention showing the bottom and inner portions thereof.

As FIG. 2 illustrates, inversion of the bottle opener 10 reveals the interior of the opener 10. Dome 11 is substantially hollow, having an inner diameter approximately $\frac{3}{8}$ inch less than the outer diameter of dome 11, which provides a vertical tubular wall 13 thickness of about 3/16 inch. While a variety of materials may be used to construct dome 11, a rigid material such as a hard plastic is preferred, and the outer surface should have a high coefficient of friction when cooperating with the hand of a user of this invention. The preferred coefficient of friction is in excess of 0.6. An apperture 20 is inscribed in vertical wall 13 to allow shaft 14 to penetrate into the interior of dome 11, substantially orthogonal to the predetermined longitudinal axis of the bottle. Handle 15 is rigidly secured to the external portion of shaft 14 and adjustment means 21 is rigidly secured to the interior end of shaft 14. Thus, rotation of handle 15 about the longitudinal axis of shaft 14 will cause similar rotation of adjustment means 21. Bracket 22 encloses adjustment means 21 with adjustable circular clamp 23, and is secured with dome 11 by eccentric securement means 12. It is preferred that adjustment means 21 comprises a helical cam and that adjustable circular clamp 23 comprises a thin rigid band with a multiplicity of camming appertures formed therein to cooperate with the cam of adjustment means 21 such that rotation of handle 15 will cause clamp 23 to vary its diameter. A conventional band and screw type hose clamp would operate similarly.

In use, handle 15 is rotated to cause expansion of clamp 23 to an appropriate diameter. Opener 10 is then placed over a bottle top with the bottle cap inserted into clamp 23. Handle 15 is then turned in an opposite direction to contract the clamp 23. When clamp 23 is reduced into clamping contact with the periphery of the bottle cap, housing 11 can be easily grasped and turned to remove the bottle cap. The enlarged size of housing 11 and leverage provided by remote handle 15 substantially reduce the hand strength needed to open a twist cap bottle. As previously stated, securement means 12 is not located at the center of dome 11. Instead, it is located as far off center as possible to place adjustment means 21 adjacent to the interior of wall 13, thereby providing maximal room within dome 11 for the expansion of clamp 23.

While this invention has been described in detail with particular reference to a preferred embodiment thereof, it will be understood that variations and modifications can be effective within the spirit and scope of the invention as described hereinbefore and as defined in the appended claims.

INDUSTRIAL APPLICABILITY

This invention is capable of exploitation in the kitchen utensil industry and is particularly useful for easily removing twist type bottle caps.

I claim:

1. A bottle opener for minimizing hand strength needed to open a twist cap bottle, comprising:

an enlarged, generally domed shaped housing;

an adjustable circular clamp secured within said housing; and a remote adjustment handle extending through said housing substantially orthogonal to the predetermined longitudinal axis of said bottle for adjusting said clamp.

2. The apparatus of claim 1 wherein said housing is rigid and substantially hollow, having an outer diameter of from about 2.50 inches to about 3.0 inches with a substantially concentric inner diameter about $\frac{3}{8}$ inch less than the outer diameter thereof.

3. The apparatus of claim 2 wherein said housing comprises a substantially vertical tubular outer wall having a thickness of about 3/16 inch, and wherein the overall height of said housing is approximately 1.50 inches.

4. The apparatus of claim 3 wherein the outer surface of said housing has a coefficient of friction in excess of 0.6 when cooperating with a user's hand.

5. The apparatus of claim 3 wherein said remote adjustment handle is rigidly mounted on an external portion of a shaft which extends through an apperture in said wall; said shaft having rigidly secured to its interior portion, an adjustment means, such that rotation of said handle causes similar rotation of said adjustment means.

6. The apparatus of claim 5 wherein said adjustment means is enclosed with said adjustable clamp by a bracket which is rigidly secured to the interior of said housing.

7. The apparatus of claim 6 wherein said adjustment means cooperates with said adjustable clamp to vary the diameter of said clamp.

8. The apparatus of claim 7 wherein said adjustment means comprises a helical cam and wherein said adjustable circular clamp comprises a thin rigid band having a multiplicity of camming appertures formed therein whereby rotation of said helical cam, in contact with one or more of said camming appertures causes said clamp to cam in a direction which increases the diameter thereof or in a direction which decreases the diameter thereof.

9. The apparatus of claim 7 wherein said adjustment means is secured substantially adjacent to the interior of said wall, thereby providing for maximum expansion of said clamp.

* * * * *